United States Patent [19]

Saurer et al.

[11] Patent Number: 4,488,818

[45] Date of Patent: Dec. 18, 1984

[54] WATCH WITH AN ANALOG DISPLAY DEVICE THE DIAL OF WHICH IS FORMED BY A LIQUID CRYSTAL DISPLAY CELL

[75] Inventors: Eric Saurer, Bevaix; Fereydoun Gharadjedaghi, Neuchatel; Yves Ruedin, St-Blaise, all of Switzerland

[73] Assignee: Asulab S.A., Bienne, Switzerland

[21] Appl. No.: 426,384

[22] Filed: Sep. 29, 1982

[30] Foreign Application Priority Data

Oct. 28, 1981 [CH] Switzerland ..... 6876/81

[51] Int. Cl.[3] ..... G04B 19/04; G04B 19/06

[52] U.S. Cl. ..... 368/71; 368/84; 368/242

[58] Field of Search ..... 368/71, 82, 84, 239, 368/242; 340/754; 350/334, 336–338

[56] References Cited

U.S. PATENT DOCUMENTS

| | | | |
|---|---|---|---|
| 4,247,930 | 1/1981 | Martin | 368/84 |
| 4,326,279 | 4/1982 | Shanks | 368/242 |
| 4,342,030 | 7/1982 | Shanks | 340/754 |
| 4,355,380 | 10/1982 | Huguenin et al. | 368/19 |
| 4,413,915 | 11/1983 | Besson | 368/84 |

OTHER PUBLICATIONS

Sun Lu, "Continuous Display Technologies for Electronic Watches", Wescon Conference, 1977 pp. 1–10.

*Primary Examiner*—Bernard Roskoski

*Attorney, Agent, or Firm*—Pollock, Vande Sande & Priddy

[57] ABSTRACT

A watch display comprises time display hands (3, 4) and a reflecting digital display (5) which acts as dial for the hands, the display being transparent under the effect of an electric field and opaque in the absence of the field.

11 Claims, 3 Drawing Figures

WATCH WITH AN ANALOG DISPLAY DEVICE THE DIAL OF WHICH IS FORMED BY A LIQUID CRYSTAL DISPLAY CELL

BACKGROUND OF THE INVENTION

The present invention relates to a watch having an analog display device, such as hands moving in front of a dial, and a liquid crystal display cell forming this dial. The cell can be set, by external action, either in a first mode in which it displays an item of data, for example a numerical indication of time, or in a second mode in which it does not display the data.

It is well known that a liquid crystal cell comprises a composite layer whose opacity is modified in the zones where it is subjected to the action of an electrical field.

A watch of the above-mentioned type is known from Japanese Patent Application No. 52-14367. In this watch, the liquid crystal display cell has a uniformly light-coloured surface when it is displaying no data. When the cell is displaying data, the symbols are presented in a dark colour on a light background. As a result, in this known watch, the dial-forming surface is constituted by the light reflector-diffuser which is located behind the cell.

This known watch has, as a disadvantage, the unaesthetic effect due to the relatively large gap between the hands and the dial-forming surface.

SUMMARY OF THE INVENTION

The object of this invention is to overcome this disadvantage.

According to the invention, the liquid crystal display cell has a composite layer which is uniformly opaque when no electrical field is applied.

Thus, the aesthetic effect of the watch is improved because the surface forming the dial. (i.e. that surface farthest behind the hands which reflects the light capable of reaching the user's eye) is located nearer the hands than the reflector-diffuser.

The cell of the watch is preferably of the type comprising a layer of liquid crystal containing a nematic compound having a positive dielectric anisotropy, and pleochroic molecules having a substantial coefficient of absorption of light for substantially all of the visible wave-lengths. A polarizer is located between the liquid crystal layer and the reflector-diffuser.

BRIEF DESCRIPTION OF THE DRAWING

The invention will be better understood on reading the description which follows of several embodiments, given by way of example, with reference to the accompanying drawings, in which.

DETAILED DESCRIPTION OF PREFERRED EMBODIMENTS

Figure 1:
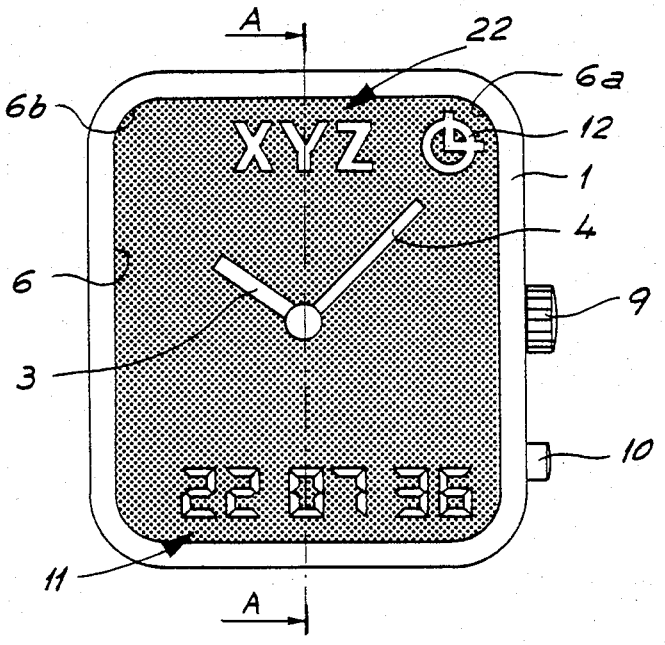
FIG. 1 is a top plan view of a watch according to an embodiment of the invention.

The Figures show a watch, the case of which comprises a caseband 1 and a watch glass 2. The watch comprises analog time display means in the form of an hour hand 3 and a minute hand 4. These hands 3, 4 are arranged above a liquid crystal display cell 5 which forms a dial for the hands 3 and 4 and which extends over the whole area of the opening 6 of the case covered by the watch glass 2. The cell has a bore 5*a* located substantially at its center. This bore accommodates the pipe arbor 3*a* carrying the hour hand 3 and the arbor 4*a* carrying the minute hand 4 by means of which the hands 3 and 4 can be mechanically driven.

Figure 2:
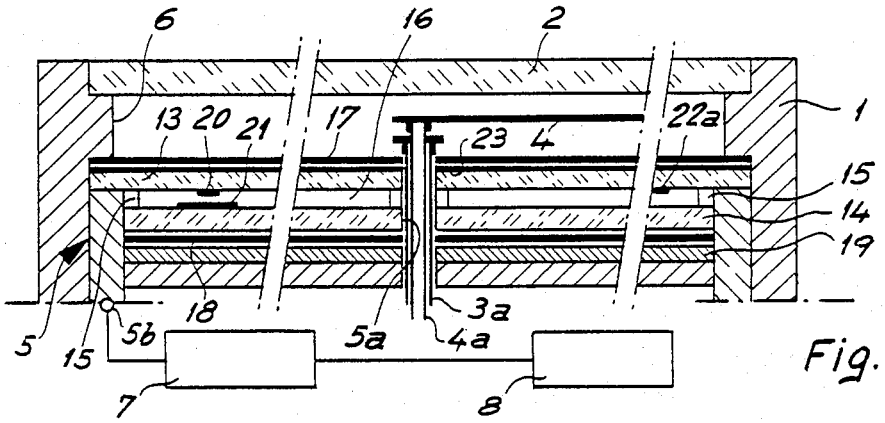
FIG. 2 is a diagrammatic sectional view taken along the line A—A of FIG. 1, showing a first constructural example of the liquid crystal display cell of the watch.
Figure 3:
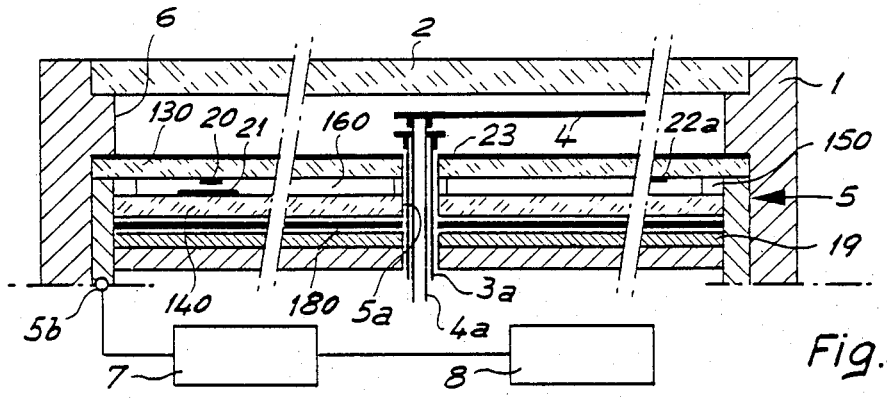
FIG. 3 is a diagrammatic sectional view taken along the line A—A of FIG. 1 showing a second constructional example of the liquid crystal display cell of the watch according to the invention.

The watch further comprises a control circuit indicated schematically by a block 7 in FIGS. 2 and 3. The circuit 7 is responsive to an actuating signal supplied by a device 8 and applies an appropriate control signal to the input terminal 5*b* of the display cell 5. The actuating device 8 comprises means allowing the input of data from outside the watch, such as a setting crown 9 and a push button 10. Obviously the crown 9 and the push button 10 could be replaced by any other devices, such as capacitative devices or photosensitive elements, which permit the entry of data into the watch.

According to the data transmitted by the device 8 to the circuit 7, the latter applies a control signal to the terminals 5*b* of the cell 5 so that this latter displays a particular item of data selected from among several types of data. The displayed data may be time-related data, such as the hour, the minute and the second, as shown in FIG. 1, or the date, information concerning time measurement, etc. At the same time as this data, which is displayed in a numerical form, the cell 5 displays a sign which is characteristic of the type of this data. Thus it can be seen in FIG. 1 that the cell 5 is displaying, in addition to data 11 concerning the hour, the minute and the second, located on the lower part of the surface of the cell 5, a stylised informative sign 12 indicating that this is time-related data. As shown in FIG. 1, it is advantageous to locate the informative sign 12 in a part of the cell which is not covered by the path of movement of the analog time-indicating hands 3, 4. If, as shown in FIG. 1, the shape of the opening is rectangular, the informative signs such as 12 are advantageously located in the two upper corners 6*a*, 6*b* of the opening.

The circuit 7 comprises, as is well known, a standard time signal generator, such as a quartz oscillator, a divider, counters and a decoder which receives the signals of counted data supplied by the counters. The device 8 comprises, for example, switches interposed between the decoder and the input terminals 5*b* of the display cell 5. The switches are for example controlled by the push button 10 which forms part of the actuating device 8. Each depression of the push button 10 produces, for example, the closing of a contact connecting a source of voltage to the input T of a T-type flip-flop, the output Q of which is connected to the control electrodes of MOS transistors constituting the above-mentioned switches. Thus, a first depression of the push button 10 produces the display by the cell 5 of an item of data such as 11 and of a sign such as 12. A second depression of the push button 10 causes this display to disappear.

FIG. 2 shows a constructional example according to which the display cell 5 is of the type of cell which is described in U.S. Pat. No. 3,731,986. This type of cell is generally known as a twisted nematic liquid crystal cell.

The cell 5 of FIG. 2 comprises a transparent front plate 13, a transparent rear plate 14 and a spacer 15 which, in conjunction with the plates 13 and 14, delimits a closed space located between the plates. This space contains a layer 16 of liquid crystal having a positive dielectric anisotropy. The layer 16 has, in the absence of an electric field, a helical structure with its axis substantially at right angle to the layer and having a total angle of twist of 90°.

The cell 5 further comprises two polarizers 17 and 18 located one on each side of the assembly formed by the plates 13 and 14 and the layer 16 of liquid crystal, the optical axes of the polarizers being parallel to each other.

The cell 5 finally comprises a wall 19 of which the surface facing the assembly formed by the plates 13 and 14 and the polarizers 17 and 18 is light-reflective and diffusing. The layer 16 and the polarizers 17 and 18 form a composite layer the opacity of which can be modified under the action of an electric field.

In the display zones which are intended to display data such as the time-related information 11 or the informative sign 12, the front plate 13 and rear plate 14 are provided with shaped electrodes 20 and 21.

When a potential difference is established between the electrodes 20 and 21, the portion of the liquid crystal 16 between the electrodes is subjected to an electric field which has the effect of eliminating the helical structure in said portion and replacing it with a homeotropic structure.

The axes of the polarizers 17 and 18 are parallel to each other. As a result, in the absence of an electric field applied to the layer of liquid crystal 16, the composite layer is uniformly opaque. Consequently, the cell 5 appears uniformly dark over the whole of its extent. The hands 3, 4, which are advantageously of a light and bright colour, stand out and are therefore easily visible against the dark background constituted by the cell 5. Moreover, the composite layer of the cell being opaque, the surface that constitutes the dial, in front of which the hands 3 and 4 move, is located at the level of the front polarizer 17 and hence much nearer to the hands than the reflective surface of the reflector-diffuser 19.

It is to be noted that the data displayed by the cell 5 are light on the dark background and only appear on demand by the user of the watch, that is to say when the latter operates the push button 10.

According to the example shown in the drawings, the cell 5 is also provided with means for permanently displaying a sign or item of data, for example a trade mark, such as the mark represented schematically by the letters XYZ at 22 in FIG. 1. This permanent display can be obtained by a metallic deposit **22*a* such as a layer of aluminium applied to one of the surfaces, for example to the interior surface of the front plate 13**. Alternatively, the trade mark sign could be displayed by means of electrodes by the application of an electrical field to the layer of liquid crystal.

Advantageously a layer 23 which is partially reflective is provided on the front of the plate 13.

According to the example shown in FIG. 3, the liquid crystal display cell 5 is of the type which is described in U.S. Pat. No. 3,551,026. This type of cell is generally called a Heilmeier cell.

The cell of the watch shown in FIG. 3 differs from that shown in FIG. 2 in that it comprises a layer 160 of nematic liquid crystal with a positive dielectric anisotropy including a pleochroic dye and in that it comprises only a single polarizer 180 located behind the cell.

The layer 160 of liquid crystal is located in a closed space delimited by a front plate 130, a rear plate 140 and a spacer 150.

The pleochroic dye contained in the layer 160 of liquid crystal advantageously has a relatively high coefficient of absorption in the greater part of the visible wave-lengths, so that the cell has, in the rest condition, that is to say in the absence of an electrical field applied to the layer 160 of liquid crystal, a substantially black or slightly tinted colour according to the proportions of pleochroic molecules constituting the dye. The dye is for example that which is described in the German Patent application No. 3 028 543.

The inner surfaces, that is to say the surfaces of the plates 130 and 140 which face the layer 160 of liquid crystal, are provided with planar alignment layers capable of inducing an alignment of the molecules of nematic liquid crystal and hence of the molecules of pleochroic dye contained in the layer 160 in a single direction parallel to the plates 130 and 140. The optical axis of the polarizer 180 is parallel to this single direction. Owing to these arrangements, in the absence of an electrical field applied to the layer 160 of liquid crystal, the cell 5 of FIG. 3 has a uniformly dark black appearance.

When the user of the watch operates the device 8 with a view to obtain the display by the cell 5 of FIG. 3 of an item of data of any type whatever, for example a time-related item of data 11, the circuit 7 applies to the terminals **5*b* a control signal such that a potential difference is established between certain electrodes 20 and certain electrodes 21 on the plates 130 and 140. As a result the layer 160 of liquid crystal is subjected, at positions located between electrodes 20 and 21, to an electrical field which eliminates the planar alignment of the molecules of the nematic liquid crystal and of the pleochroic dye and replaces this alignment with a homeotropic alignment which has the property of allowing polarized light to pass, whether its frequency spectrum and the orientation of its plane of polarization may be. As a result, the data displayed by the cell 5 of FIG. 3** appear light on a dark background.

In the absence of an electrical field applied to the layer 160 of liquid crystal, the composite layer, formed by the layer 160 of liquid crystal and of the polarizer 180, is uniformly opaque over the whole extent of the cell 5. When an electrical field is applied between two electrodes 20 and 21 of certain display zones, the layer does not become appreciably transparent except at the display zones, that is to say at the locations where the layer 160 of liquid crystal is subjected to an electrical field. As a result as in the case of FIG. 2, the surface that forms the dial in front of which the hands 3 and 4 move is located distinctly above the reflective surface of the reflector-diffuser 19.

The distance separating the hands 3 and 4 from the dial-forming surface is thus relatively small, which appreciably improves the aesthetic appearance of the watch.

The spacer 150 is advantageously made of a bonding material using a resin and containing a pigmentation agent having substantially the same colour as the pleochroic dye contained in the layer 160 of liquid crystal. Thus, the spacer 150 is an integral part of the surface which forms the dial. The resin may be an epoxy resin, a polyester, a phenolic resin, an acrylic resin, a polyurethane or a derivative of those constituents.

In order not to impair the mechanical characteristics of the spacer, it is desirable to have the lowest density pigmentation agent. Due to the higher absorptivity of inorganic pigments it is possible to have an appearance similar to that obtained by pleochroic molecules, for a lower density. The density of the pigmentation agent which makes it possible to obtain a suitable coloration of the material the spacer of which is composed, is distinctly lower than that of a dye having the same effect.

When the dye is black, the employed pigmentation agent may be: carbon black, lamp black, a metal oxide, etc, mixed or not with pleochroic molecules.

As a variant of the solution previously described, the polarizer 180 may be located in front of the front plate 130 and not behind the rear plate 140 as shown in FIG. 3.

According to another embodiment, the cell 5 may be of the type which is described in U.S. Pat. No. 3,833,287. The layer 160 of liquid crystal contains, in addition, a chiralic constituent which induces a helical structure, the pitch of which is such that all the components of the light are absorbed.

Under the effect of an electrical field applied in particular zones of the layer 160 of liquid crystal, the molecules of this layer become locally oriented perpendicularly to the plates in such a manner that the light is no longer absorbed by the pleochroic molecules, which render these zones transparent. In this case, the polarizer 180 becomes unnecessary and may therefore be eliminated.

There have thus been described three embodiments of the invention which enable a dark dial to be obtained which, while providing the user with a certain number of data complementary to the time, produces a remarkable aesthetic effect, because it appears very close to the hands.

It must be clearly stated that the effect obtained is better as the amount of light reflected by the elements between the layer of liquid crystal and the hands is large in relation to the amount of light which traverses the composite layer after having been reflected by the reflector-diffuser, and this for the entire width of the spectrum. This indicates a judicious choice of the absorption characteristics of the reflector-diffuser, of the polarizers and/or of the pleochroic molecules.

Thus if one wishes to display information in grey on a black background, one selects polarizers and/or pleochroic molecules which are absorbent within the whole width of the visible spectrum and a white reflector-diffuser. If one wishes to obtain a display cell the data of which are coloured on a black background, one selects polarizers and/or pleochroic molecules which are absorbent within the whole width of the visible spectrum, and a coloured reflector-diffuser. If one wishes to obtain a display cell, the dark background of which is slightly tinted and the data of which are coloured, one selects polarisers and/or pleochroic molecules which are absorbent within the whole width of the spectrum, except for certain wave-lengths, and a coloured reflector-diffuser.

The attainment of a tinted background is limited by the fact that the amount of light which traverses the composite layer after having been reflected by the reflector-diffuser is increased. This limitation can be removed by means of the partly reflective layer 23 which may be carried by the front plate of the cell. This layer increases the amount of light reflected by the elements between the layer of liquid crystal and the hands, which also enables an increase in the amount of light that traverses the composite layer after having been reflected by the reflector-diffuser, without at the same time losing the desired effect.

While it is thus possible to tint the base in a more pronounced manner, it must nevertheless be pointed out that an exaggeration in this sense leads to a reduction in the contrast of the display.

What is claimed is:

1. In a watch comprising time display hands adapted to be mechanically driven; and a digital display cell positioned behind said hands to form a dial for said hands, said digital display cell including a composite layer comprising at least one layer of liquid crystal and having display zones which respond to an electrical field provided in response to an external action by a modification of their opacity; a fluid-tight enclosure comprising a front plate, a rear plate and spacing and closing means which define a closed space containing the layer of liquid crystal; and light-reflecting and diffusing means disposed behind said composite layer; the improvement wherein said cell is of the type in which said composite layer is transparent under the effect of said field and opaque in the absence of the field, with the result that said layer has a uniformly opaque appearance in the absence of said field and thus forms itself the dial for said hands.

2. The watch of claim 1, wherein the composite layer comprises a first polarizer located in front of the layer of liquid crystal and a second polarizer located between the layer of liquid crystal and said light-reflecting and -diffusing means; the layer of liquid crystal has a helical structure the axis of which is substantially at a right angle to the plane of said layer, the angle of twist of the helix being 90°; and the axes of said polarizer are parallel to each other.

3. The watch of claim 1, wherein the composite layer further comprises a polarizer and the layer of liquid crystal comprises a nematic compound and a pleochroic dye.

4. The watch of claim 3, wherein said polarizer is adjacent to the light-reflecting means.

5. The watch of claim 1, wherein the layer of liquid crystal comprises a nematic compound, a pleochroic dye and a chiralic compound which induces a helical structure in said layer.

6. The watch of claims 3, 4 or 5, wherein the pleochroic dye has a relatively high coefficient of absorption for substantially all of the wave-lengths of visible light.

7. The watch of claim 3, 4 or 5 wherein said spacing and closing means comprises a bonding material and a pigmentation agent having substantially the same colour as the pleochroic dye.

8. The Watch of claims 1, 2, 3, 4 or 5 wherein the front plate carries a partly reflective layer on one of its surfaces.

9. The watch of claim 6 wherein said spacing and closing means comprises a bonding material and a pigmentation agent having substantially the same colour as the pleochroic dye.

10. The watch of claim 6 wherein the front plate carries a partly reflective layer on one of its surfaces.

11. The watch of claim 7 wherein the front plate carries a partly reflective layer on one of its surfaces.

* * * * *